US006244469B1

(12) United States Patent
Knickerbocker

(10) Patent No.: US 6,244,469 B1
(45) Date of Patent: Jun. 12, 2001

(54) CHILD RESISTANT TRIGGER FOR DISPENSER

(76) Inventor: Michael G. Knickerbocker, 832 Stonebridge La., Crystal Lake, IL (US) 60014

( * ) Notice: Subject to any disclaimer, the term of this patent is extended or adjusted under 35 U.S.C. 154(b) by 0 days.

(21) Appl. No.: 09/229,438

(22) Filed: Jan. 13, 1999

Related U.S. Application Data

(60) Provisional application No. 60/071,343, filed on Jan. 14, 1998.

(51) Int. Cl.[7] ..... B67D 5/40
(52) U.S. Cl. ..... 222/153.14; 222/383.1
(58) Field of Search ..... 222/153.1, 153.13, 222/153.14, 380, 383.1

(56) References Cited

U.S. PATENT DOCUMENTS

| | | | |
|---|---|---|---|
| 3,209,949 | 10/1965 | Gurtler | 222/49 |
| 3,602,399 | 8/1971 | Litman et al. | 222/153 |
| 3,749,286 | 7/1973 | Douglas | 222/153 |
| 3,927,834 | 12/1975 | Tada | 239/359 |
| 3,973,700 | 8/1976 | Schmidt et al. | 222/153 |
| 4,067,482 | 1/1978 | Vogel et al. | 222/152 |
| 4,159,067 | 6/1979 | Akers | 222/153 |
| 4,204,614 | 5/1980 | Reeve | 222/153 |
| 4,245,759 | 1/1981 | Baker et al. | 222/146 HE |
| 4,346,821 | 8/1982 | Wesner et al. | 222/153 |
| 4,373,644 | 2/1983 | Bennett | 222/153 |
| 4,432,483 | 2/1984 | Kuck | 227/8 |
| 4,441,633 | 4/1984 | Bennett | 222/153 |
| 4,516,695 | 5/1985 | Garneau | 222/153 |
| 4,534,512 | 8/1985 | Chow et al. | 239/394 |
| 4,538,745 | 9/1985 | Dunning et al. | 222/153 |
| 4,669,636 | 6/1987 | Miyata | 222/153 |
| 4,678,105 | 7/1987 | Heck | 222/153 |
| 4,838,460 | 6/1989 | Moore et al. | 222/153 |
| 4,946,074 | 8/1990 | Grogan | 222/153 |
| 5,088,628 | 2/1992 | Knickerbocker | 222/153 |
| 5,114,049 | 5/1992 | Knickerbocker | 222/153 |
| 5,169,032 | 12/1992 | Steijns et al. | 222/153 |
| 5,228,600 | 7/1993 | Steijns et al. | 222/153 |
| 5,238,152 | 8/1993 | Maas et al. | 222/153 |
| 5,297,701 | 3/1994 | Steijns et al. | 222/153 |
| 5,336,014 | 8/1994 | Keller | 403/24 |
| 5,366,118 | 11/1994 | Ciammitti et al. | 222/153 |
| 5,477,989 | 12/1995 | Maas et al. | 222/153.1 |
| 5,492,251 | 2/1996 | Albini et al. | 222/153.13 |
| 5,535,952 | 7/1996 | Tada | 239/333 |
| 5,560,545 | 10/1996 | Grogan et al. | 239/304 |
| 5,562,219 | 10/1996 | de Pous et al. | 215/274 |
| 5,564,604 | 10/1996 | Tada | 222/153.14 |
| 5,657,911 * | 8/1997 | Mogler et al. | 222/153.14 |
| 5,687,880 * | 11/1997 | Maas et al. | 222/153.14 |

* cited by examiner

*Primary Examiner*—Joseph A. Kaufman

(57) ABSTRACT

A child resistant trigger is disclosed for a fluid dispenser. The fluid dispenser comprises a body pivotably supporting the trigger for dispensing the fluid from a container upon movement of the trigger between an extended position and a retracted position. The trigger comprises a latch movably mounted on the trigger. The latch is biased into a locking position whereat the latch engages the body for inhibiting the movement of the trigger from the extended position. The latch is movable into an unlocking position whereat the latch disengages from the body for permitting the movement of the trigger from the extended position into the retracted position for dispensing the fluid from the container.

22 Claims, 6 Drawing Sheets

CHILD RESISTANT TRIGGER FOR DISPENSER

CROSS-REFERENCE TO RELATED APPLICATIONS

This application claims benefit of U.S. Patent Provisional application Ser. No. 60/071,343 filed Jan. 14, 1998. All subject matter set forth in provisional application Ser. No. 60/071,343 is hereby incorporated by reference into the present application as if fully set forth herein.

BACKGROUND OF THE INVENTION

1. Field of the Invention

This invention relates to fluid sprinkling and more particularly to a child resistant device for a trigger of a fluid dispenser.

2. Background of the Invention

A typical hand held fluid sprinkling device comprises a container with a fluid dispenser connected to the container for dispensing a fluid from the container. In many cases, the fluid dispenser has a trigger for dispensing the fluid from the container through a terminal orifice upon actuation of the trigger of the fluid dispenser.

One type of fluid dispenser includes a trigger pump for dispensing the fluid from the container upon movement of a trigger between an extended position and a retracted position. The trigger is normally biased into the extended or unattended position. The trigger pump dispenses the fluid from a terminal orifice upon the reciprocation of the trigger between the extended position and the retracted position.

Various types of child resistant devices have been proposed by the prior art for a hand held fluid sprinkling device. In order to qualify as a child resistant fluid sprinkling device, the fluid sprinkling device must contain two independent characteristics.

First, the fluid dispenser must be attached to the container in such a manner to inhibit the removal of the fluid dispenser from the container by a child. Various means are available to attach the fluid dispenser to the container as should be well known to those skilled into art.

Secondly, the fluid dispenser must be prevented from dispensing the fluid from the terminal orifice. The fluid dispenser may be prevented from dispensing the fluid from the terminal orifice either by closing the terminal orifice or by immobilizing the trigger. Many in the prior art have addressed the problem of preventing the dispensing of the fluid from the terminal orifice.

U.S. Pat. No. 3,209,949 to Gurtler discloses a dispensing device for a container of fluid under pressure, comprising a valve body mountable on said container to receive said fluid therefrom. The body has a discharge orifice and a bore extending through said valve body and communicating with said orifice. A valve sleeve movably mounts in said valve body bore and is cooperable therewith to open and close said bore. Means actuate the sleeve to pass fluid through said bore and orifice when said sleeve is moved thereby to clear said bore. A stem is axially movable in said valve sleeve, and a stem body at one end of the stem extends beyond said valve sleeve within said valve body and is adapted to be in communication with the pressure in said container, said stem has another end extending beyond said sleeve outside of the valve body and whereby pressure applied in said valve body to said stem body moves said stem body outwardly of said valve sleeve and extends said other end of the stem beyond said sleeve to indicate the magnitude of pressure in the valve body.

U.S. Pat. No. 3,602,399 to Litman relates generally to hand operated dispensers for spraying fluid from pressurized containers and is particularly concerned with such dispensers that are adapted to be carried by the user, and that provide means for more accurately directing the spray as well as providing a number of safety features preventing accidental or other discharge of fluid when not desired.

U.S. Pat. No. 3,749,286 to Douglas discloses an actuator cap for use with conventional pressurized containers having a slidable locking member which prevents accidental discharge of the container contents. The slidable locking member has a flat base having one end bifurcated. The locking member is mounted to the actuator cap so that when moved to lock position its bifurcated end wedges between the actuator and the container prevents movement of the actuator so that the container valve is not opened to discharge contents. The slidable locking member may also be provided with a sleeve-like segment attached to the base. This sleeve-like segment telescopically fits over a horizontal spout provided for the actuator cap. This modified slidable locking member has the dual function of actuator lock and spout extender.

U.S. Pat. No. 3,927,834 to Tada discloses a sprayer comprising a piston capable of being reciprocally moved in a cylindrical chamber, a lever for operating said piston, a valve for guiding a spray liquid from a container to said chamber, and a locking member for fixing said lever in a prescribed position and simultaneously allowing said piston to close said valve when the sprayer is out of use.

U.S. Pat. No. 3,973,700 to Schmidt et al. discloses a pump or spray comprised of a flexible bellows having a non-collapsible extension in which there are inlet and outlet ports. Flapper valves, integral with the extension, open and close the ports on the compression and expansion strokes of the bellows. The bellows may be finger or trigger operated.

U.S. Pat. No. 4,067,482 to Vogel et al. discloses a dispensing cap for valves for aerosol containers, comprising a stationary body designed to be secured to the container and a dispensing push button which is designed to be connected to the actuating stem of the valve, wherein the body has a deformable portion which is hingedly or pivotally mounted on the remainder of the body at its two ends and which can be displaced inwards into the body for actuating the push button, and a frangible device which acts as a tamperproof device and which initially is connected first to the deformable portion of the body at least two points lying on opposite sides of a hinge or pivotal connection of the deformable portion, and wherein the device, until the purchaser tears it off, prevents the deformable portion from being pressed inwards into the body.

U.S. Pat. No. 4,159,067 to Akers discloses a pump including components designed for fabrication by high speed injection molding from plastic material, and is adapted for mounting by a suitable closure to a container. The basic components are a base, a head and an actuator. The base provides a sealed closure with the mouth of the container and provides a support barrel for the head. The support barrel also includes structure providing an inlet check valve seat, and for supporting the dip tube. The head includes a body having a dependent support stem for latching engagement with the support barrel, and a laterally projecting hollow plunger for supporting the actuator. The actuator is essentially a hollow barrel received over the plunger to define a variable pumping chamber, having a discharge orifice at its distal end, and having a trigger handle for manipulation and pumping action by the user. A compression spring within the pumping chamber assists the pumping action. These basic components include coacting structure for latching the plunger in a locked condition where the container can be shipped with the pump assembly attached and leakage is prevented, and wherein the latching structure is designed to inhibit release of the plunger to the pumping position by children. As an accompanying structure, the pump base and container may have coacting structural features for latching the pump assembly to the container in a manner to inhibit removal of the pump assembly from the container by children.

U.S. Pat. No. 4,204,614 to Reeve discloses a fluid dispenser including an actuator containing fluid passages defining a discharge path for fluid from a supply container to a discharge orifice, a needle valve lying adjacent the discharge path, a nipple surrounding the needle valve and a nozzle cap having an end wall containing a discharge orifice and being threadedly engaged with the nipple for movement of the end wall toward and away from the valve upon cap rotation. Discharge through the orifice may be positively shut "off" upon rotation of the cap which causes the valve to be seated against the discharge orifice, and the nozzle cap may be locked in an "off" position upon engagement between a spring biased tab provided on the actuator and an inwardly extending shoulder provided on the skirt of the cap. A ramp member on the cap includes a ramp surface and the shoulder so as to effect inward deflection of the tab upon engagement with the ramp surface during cap rotation toward the "off" position. The tab then snaps into place against the shoulder upon continued cap rotation so as to prevent rotation of the cap which would cause the valve to unseat from the discharge orifice. The tab is manually deflectable for disengaging it from the shoulder to permit cap rotation allowing its end wall to move away from the valve.

U.S. Pat. No. 4,245,759 to Baker et al. discloses a hand held adhesive dispensing gun of the type intended to be rotatably mounted at the end of a heated flexible hose through which adhesive is supplied to the gun. The gun body includes a pivot post extending outwardly from the gun barrel. This post is pivotally mounted within a heated pivot sleeve which extends for approximately the full length of the post. Heat imparted to the sleeve by an electrical resistance heater mounted therein maintains the adhesive in the post and the gun barrel in the molten state. The design is such that there is no need for an electrical resistance heater in the rotatable gun and thus no need for an electrical cord to extend between the rotatable gun and the non-rotatable flexible hose.

U.S. Pat. No. 4,346,821 to Wesner et al. discloses a child-resistant safety closure provided for closing the outlet of a hand-operated fluid product sprayer dispenser used on a container to prevent leaks from the container during periods of non-use and to resist accidental use by children or unwary adults. The closure cannot be moved from an "outlet closed" position to an "outlet open" position without the performance of at least two discrete, predetermined definite actions by the user to first disable a lock and then to linearly or rotatably move the cap into the "outlet open" position to permit spraying or dispensing. A closing member is connected to the bottom portion of the sprayer for removably mounting the sprayer to the container and closing the same. The member and the sprayer to which it is connected cannot be removed without the performance of at least two discrete, predetermined definite actions, which actions are difficult if not impossible for young children to perform.

U.S. Pat. No. 4,373,644 to Bennett discloses a manually operated trigger pump body, a circular cap disposed below the body and adapted to engage a container having material to be pumped out, a generally vertical trigger pivotally coupled at its upper end to the body and a linkage coupled at one end to the trigger intermediate its ends and extending inclinedly upwards from the coupled end into the body. A locking device is securable to and is manually rotatable about the cap. A generally horizontal arm integral at one end with the device extends radially outward from the cap. The arm has a radially extending recess in its top surface. The device is rotatable to a locked position at which the other end of the arm is aligned with but is inwardly spaced from the trigger and the linkage engages the recess. At this point, when the trigger is squeezed, the movement between the trigger and the other end of the arm is insufficient to actuate the pump, but is large enough to raise the linkage partially out of the recess. However, if the means is rotated to move the other end of the arm out of alignment with the trigger while the trigger remains squeezed, the linkage will be raised completely out of the recess. The pump is then unlocked and can be operated normally.

U.S. Pat. No. 4,432,483 to Kuck relates to a safety release mechanism for use with a power operated driving apparatus for fasteners which includes a pivotally supported trigger or release lever housing for actuating or releasing the driving apparatus upon engagement with a release pin or switch. The safety release mechanism is supported in the trigger housing between the trigger and the release pin and is biased by a spring to the safety or "off" position which prevents the trigger lever from engaging the release pin. Upon movement of the safety release member to the actuated or release position, the trigger lever is engageable with the release pin or switch to actuate the power operated driving apparatus.

U.S. Pat. No. 4,441,633 to Bennett discloses a manually operable trigger pump having a pump body, a circular cap disposed below the body and adapted to engage a container having material to be pumped out, a generally vertical trigger pivotally coupled at its upper end to the body and a linkage coupled at one end to the trigger intermediate its ends and extending from the coupled end into the body. The trigger has a surface adjacent the body. The surface has a longitudinally extending groove therein. A locking device is detachably securable to and is manually rotatable about the cap. A generally horizontal arm integral at one end with the device extends radially outward from the cap. The other end of the arm has a tip which is engagable with and disengagable from the trigger surface groove. The device is rotatable to a locked position at which the tip engages the groove. At this point, when the trigger is squeezed, the movement of the trigger is insufficient to actuate the pump. However, if the trigger is pivoted in opposite direction and at the same time the device is rotated to move the tip out of engagement with the groove, the pump is then unlocked and can be operated normally.

U.S. Pat. No. 4,516,695 to Garneau discloses a child-resistant nozzle in combination with a hand operated sprayer. The nozzle and the discharge end of the sprayer are movable into positions of relative adjustment including a liquid flow OFF position and one or more liquid flowing positions and have cooperating surfaces in which passages are formed, which passages when brought into register by relative adjustment of the nozzle and discharge end determine the mode of liquid discharge, i.e., SPRAY or STREAM. Locking members are also provided on the nozzle or discharge end which cooperate when engaged by other parts of the device to prevent sprayer operation by preventing relative adjustment of the nozzle and discharge end from said liquid flow OFF position without the application, simultaneously, of discrete, predetermined actions of the members and parts.

U.S. Pat. No. 4,534,512 to Chow et al. discloses a fluid dispenser, preferably a pistol grip type hose nozzle, which affords no flow, solid misty cone spray and solid jet spray capabilities and contains a fluid flow rate control feature for instantaneous adjustment of the rate of fluid flow through the dispenser.

U.S. Pat. No. 4,538,745 to Dunning et al. discloses a trigger sprayer for generating a spray of liquid from a container comprising five parts including a housing having a tubular piston with an open ended liquid flow passageway therein. A tubular actuator member slidably received over the piston has a trigger rigidly extending therefrom and defining a chamber therein with a spray orifice at one end. A rod is disposed in the actuator member and includes a frustoconical skirt which forms a valve in the chamber across the spray orifice. An inlet valve is carried by the tubular piston and includes an extended valve portion slidably seated on the rod and a biasing spring disposed between the valves. The inlet valve may include a shipping seal member formed integrally therewith and disposed on the inlet passage to seal it until the sprayer is ready for use whereupon the rod will displace or break the seal upon actuation of the sprayer.

U.S. Pat. No. 4,669,636 to Miyata discloses a cartridge type dispensing gun comprising a housing and a barrel in which is mounted a cartridge containing a supply of viscous material. A plunger is driven to extend from the housing into the barrel for pushing a piston at the rear end of the cartridge to force the contents thereof out of a spout formed at the front end of the cartridge. The spout is in use to be cut off at an angle of about 45° to leave an angled edge which is utilized as a spatula when applying a bead of viscous material to a surface being treated. A joint assembly connects the barrel to the housing in such a manner that the barrel together with the cartridge received therein is rotatable about its axis with respect to the latter and is locked in one of a plurality of angularly displaced positions about that axis, whereby the angled edge of the spout can be adjusted to change its angular orientation so as to be effectively utilized as a spatula depending upon differing requirements of the surface to be treated while allowing the housing to be held at a comfortable position.

U.S. Pat. No. 4,678,105 to Heck discloses a safety lock mechanism for a cleaning wand. A three position slide switch alternately engages a pivotal trigger and/or a pivotal door on the end of the wand handle opposite the cleaning head. In the first position, the trigger is locked and the door openable. In the second position, the trigger and door are both locked. In the third position, the handle door is locked but the trigger is operable. Controlled engagement of the trigger and/or door with the slide switch prohibits unwanted loss or discharge of cleaning fluid.

U.S. Pat. No. 4,838,460 to Moore et al. discloses a dispenser for lotions, creams and the like which has an annular collar in the form of a rotatable cam ring which may be turned to rock an actuator toward a dispensing, open position or toward a closed, non-dispensing position. The cam ring has cam tracks that support the actuator when in its open, dispensing position so that finger pressure exerted on the actuator to pump products from the dispenser does not inadvertently rock the actuator toward its closed position. In preferred forms of the invention, a wall section formed as part of a shroud surrounding the actuator is yieldably biased in an inwardly direction, and snaps over the outlet of the actuator to close the outlet channel once the actuator has been pivoted toward its closed, non-dispensing position.

U.S. Pat. No. 4,946,074 to Grogan discloses a tamper evident manually actuated pump sprayer including a locking device which, according to one embodiment, extends between the trigger actuator and a confronting portion of the pump body and abuts against a trigger flange. In another embodiment, the device engages the underside of the trigger and snap fits into the sprayer nozzle cap located adjacent the trigger.

U.S. Pat. No. 5,088,628 to Knickerbocker discloses a child-resistant element in the form of an overcap surrounding a rectangular-shaped nozzle at the nozzle end of a manually actuated liquid dispenser, the nozzle being mounted for rotation between discharge open and closed positions. The overcap has an opening in its end wall and is mounted on the nozzle for manual axial movement between extended and retracted positions and is rotatable together with the nozzle. A flat surface of the overcap overlies the flat surface of the dispenser body in the retracted position for resisting rotation of the nozzle from its closed position. The overcap in its extended position permits rotation of the nozzle from its closed position to its open position.

U.S. Pat. No. 5,114,049 to Knickerbocker discloses a child-resistant trigger operated pump dispenser which has a latch pivotally mounted on the trigger for preventing trigger actuation. The latch has an arm projecting forwardly of the trigger to facilitate pivotal movement of the latch against the bias of the spring for unlocking the trigger to permit pumping. The latch is automatically returned to its locking position at the end of each pumping operation.

U.S. Pat. No. 5,169,032 to Steijns et al. discloses a trigger operated fluid dispensing device adapted to be mounted to a container. The device comprises a body having a top wall portion and front end portion. A nozzle assembly is provided at the front of the body and comprises a nose bushing at the front end of the body and a nozzle cap rotatably mounted to the nose bushing. The nozzle cap has blocking structure that is engageable with structure that prevents rotation of the nozzle cap. A pull-away piece is detachably connected to the top wall portion of the body and has extending structure extending into the area between the nozzle cap and the front end of the body for engaging the blocking structure for preventing relative movement between the nozzle cap and the body.

U.S. Pat. No. 5,228,600 to Steijns et al. discloses a trigger operated fluid dispensing device for mounting to a container comprising a body having a front end including opposed side walls at the front end, a nose bushing extending from the front end between the body side walls and at least one elongate nozzle cap blocking member which extends from the body front end and which is adapted to engage and prevent rotation of a nozzle cap upon rotation of the cap without manipulation of the body side wall. A nozzle assembly at the body front end includes the nose bushing, a nozzle cap received on the nose bushing and cooperating structure on or in the nozzle cap and on or in the nose bushing for selectively establishing an off position. The nozzle cap has a spray position or a stream position of the nozzle cap upon rotation of the nozzle cap. The nozzle cap is mounted for rotation on the nose bushing between the three positions and the nozzle cap and engaging structure therein positioned adjacent the blocking member for engaging the blocking member when someone attempts to rotate the nozzle cap without manipulating the body side walls. The side walls of the body at the front end are deflectable inwardly of the body so that when the side walls are squeezed inwardly, they engage and move inwardly of the blocking member to permit the engaging structure to move past the blocking member when the nozzle cap is rotated at the same time the body side walls are squeezed.

U.S. Pat, No. 5,238,152 to Maas et al. discloses a child resistant trigger sprayer bottle cap/bottle neck assembly comprising a trigger sprayer having a body including a cylindrical base. First, coupling structure in the form of at least one deflectable tab with an opening therein is incorporated into the cylindrical base for coupling to a bottle neck. Second, coupling structure in the form of a locking lug is provided on a bottle neck and is adapted to engage and couple with the first coupling structure by reason of the lug being received in the opening in the tab. There is also provided a locking ring which is received over the cylindrical base mounted on the neck for maintaining the first and second coupling structures in a coupled locked position.

U.S. Pat. No. 5,297,701 to Steijns et al. discloses a trigger operated dispensing device for mounting to a container comprising a body made of plastic material and having a pumping chamber therein. The pumping chamber has an open outer end and an inner back wall, a pumping mechanism associated with the body and includes a plastic piston situated in the pumping chamber and a plastic trigger coupled to the body. Non-metal biasing structure is situated between the trigger and the body for biasing the piston out of the pumping chamber. Non-metal fluid inlet structure and non-metal fluid outlet structure are associated with the pumping chamber and comprise first and second plastic flap valves in or adjacent the back wall. Also provided is nonmetal structure for coupling the body to the container. The trigger operated dispensing device has only parts made of non-metal or synthetic material therein.

U.S. Pat. No. 5,336,014 to Keller discloses a manually operated dispensing appliance for a double dispensing cartridge for two-component substances, said cartridge is plugged onto said appliance by means of a flange. For the purpose of a solid attachment of said cartridge to the housing of said appliance, a securing flap is provided which is hinged on said housing and comprises a locking portion which engages behind the upper edge of said attaching flange as well as a portion which engages in a recess of said housing and whose end is shaped as an articulation. A manual dispensing appliance having such a securing flap is more reliable in operation and will not drip when the trigger lever is released.

U.S. Pat. No. 5,366,118 to Ciammitti et al. discloses a holder for an aerosol canister. The holder has a housing and a cap. The cap receives the valve stem of the canister and when depressed will discharge the contents of the canister at a discharge nozzle in the cap. An annular locking ring has a projection which in one position prevents the cup from being pressed downwardly relative to the housing.

U.S. Pat. No. 5,477,989 to Maas et al. discloses a child-resistant nozzle cover used to cover a nozzle cap of a nozzle assembly for a trigger sprayer having a body, the nozzle assembly including a nose bushing at a front end of the body, the nozzle cap being rotatably mounted on the nose bushing of the sprayer, and the nozzle cap having a proximal end, a distal end including a generally annular rear edge, and an outer surface. The cover comprises a generally annular hood substantially covering the outer surface of the nozzle cap, being rotatable about the nozzle cap and nose bushing and having a proximal end, a distal end and outer peripheral surface and an inner generally annular surface. Retaining structure is provided at the proximal end of the hood for retaining the hood on the nozzle assembly. The hood is made of flexible or resilient material so that upon applying sufficient radial forces to the hood generally on a diameter extending transversely of the hood, the hood becomes distorted and frictionally engages the nozzle cap whereby the nozzle cap can be rotated by rotating the hood then engaging the nozzle cap.

U.S. Pat. No. 5,492,251 to Albini et al. discloses a pressurized fluid dispenser adapted to be fitted into the stem of a fluid delivery pump. A skirt portion is flexibly connected to the remaining portion of the dispenser. A tongue projects from the skirt portion. The tongue may be pressed to flex the skirt portion inwardly. A tooth on the outer surface of the free end of the skirt portion projects outwardly. The tooth is snap-engageable with an annular rib which projects into the interior of an aperture in the top of a ring cap adapted to attach the fluid delivery pump to a container mouth.

U.S. Pat. No. 5,535,952 to Tada discloses a safety mechanism for a trigger activated dispenser which dispenses a pressurized fluid including an engaging piece connected to an upper surface of a dispenser body by a hinge. The engaging piece, the dispenser body and the hinge are molded integrally from a plastic material and an engaging groove is formed on an upper surface of a nozzle cap to receive the engaging piece when the nozzle cap is rotated to an "off" position. When the engaging piece is received in the engaging groove in the nozzle cap, the nozzle cap is locked in the "off" state and the nozzle cap is removed from being rotated to any position at which liquid can flow.

U.S. Pat. No. 5,560,545 discloses a fluid dispenser for simultaneously dispensing disparate fluids separately stored in separate fluid compartments of a container including a single pump cylinder defining together with a dual seal piston a pair of in-line pump chambers for separately and simultaneously pumping the disparate fluids along separate discharge paths.

U.S. Pat. No. 5,562,219 to de Pous et al. discloses an attaching ring or fixing ring provided for attaching or fixing a dispenser member to a neck of a receptacle containing a substance to be dispensed. The ring is annular and has a bottom portion and a top portion. In a preferred embodiment, the bottom portion includes snap-fastening tabs for fixing the ring to the neck. The top portion includes an opening for the dispenser and a surrounding structure for securing the dispenser member to the neck. The top portion further includes at least one guide wall element extending parallel to the longitudinal axis of the dispenser member and around the periphery of the fixing ring substantially in line with the snap-fastening tabs. A hoop can be provided for preventing the tabs from splaying apart. The hoop can include an internal projection, such as a vertical rib or a thread.

U.S. Pat. No. 5,564,604 to Tada discloses a hook formed on the rear surface of a nozzle cover. A cantilever is formed on the front surface of a nozzle and extends forward. An engaging portion engageable with the hook, such as another hook is formed on the upper surface of the cantilever. The hook of the nozzle cover is disengaged with the hook of the cantilever by pushing the cantilever and bending the cantilever downward.

Many of the above prior art devices required considerable design changes to the conventional fluid sprinkling device for immobilizing the trigger of a fluid dispenser. In many cases, these considerable design changes required the addition of component parts as well as changes in the molds of the existing component parts of the fluid sprinkling device. The addition of component parts required a change in the main assembly machines and/or required the use of a subassembly machine. The addition of component parts as well as the additional subassembly machine added substantially to the cost of the molds as well as added substantially to the cost of production of the fluid sprinkling device.

In my prior U.S. Pat. No. 5,114,049, I disclosed a novel fluid sprinkling device for immobilizing the trigger of a fluid dispenser for preventing the dispensing of the fluid from the terminal orifice. This fluid dispenser device automatically locked the trigger into an extended or unattended position. A separate latch was attached to the trigger to hold the trigger away from the main fluid dispenser structure. Unfortunately, the region at which the trigger engages the main fluid dispenser structure was thin and flexible due to the fabrication requirements and material of construction. Accordingly, the fluid dispenser device of my prior U.S. Pat. No. 5,114,049 could not withstand a high force generated on the trigger and collapses under the pressure applied by an operator to the locked latch through the trigger.

Therefore, it is an object of the present invention to provide an improved child resistant device for a trigger of a fluid dispenser that automatically immobilizes the trigger.

Another object of this invention is to provide an improved child resistant device for a trigger of a fluid dispenser incorporating a latch for engaging with a body of the fluid dispenser for inhibiting the movement of the trigger.

Another object of this invention is to provide an improved child resistant device for a trigger of a fluid dispenser incorporating a latch for inhibiting the movement of the trigger with high structural strength to withstand a tampering force applied to the trigger.

Another object of this invention is to provide an improved child resistant device for a trigger of a fluid dispenser incorporating a latch for inhibiting the movement of the trigger without major affects on the aesthetics of the fluid sprinkling device.

Another object of this invention is to provide an improved child resistant device for a trigger of a fluid dispenser incorporating a latch integrally formed with the trigger for inhibiting the movement of the trigger.

Another object of this invention is to provide an improved child resistant device for a trigger of a fluid dispenser incorporating a latch for inhibiting the movement of the trigger without adding additional components to the system.

Another object of this invention is to provide an improved child resistant device for a trigger of a fluid dispenser incorporating a latch for inhibiting the movement of the trigger that does not require any additional material.

Another object of this invention is to provide an improved child resistant device for a trigger of a fluid dispenser incorporating a latch for inhibiting the movement of the trigger that does not require more complicated assembly machines.

Another object of this invention is to provide an improved child resistant device for a trigger of a fluid dispenser incorporating a latch for inhibiting the movement of the trigger that does not increase the material cost of the fluid dispenser.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to a child resistant trigger for use with a fluid dispenser. The fluid dispenser comprises a body pivotably supporting the trigger for dispensing the fluid from a container upon movement of the trigger between an extended position and a retracted position. The child resistant trigger comprises a latch movably mounted on the trigger. Bias means biases the latch into a locking position whereat the latch engages the body for inhibiting the movement of the trigger from the extended position. The latch is movable into an unlocking position whereat the latch disengages from the body for permitting the movement of the trigger from the extended position.

In one embodiment of the invention, a pivot pivotably mounts the latch on the trigger about a latch axis. The trigger is pivotably mounted to the body about a trigger axis with the latch axis being substantially aligned to be parallel with the trigger axis.

Preferably, the latch is integrally formed with the trigger with the pivot integrally interconnecting the latch and the trigger. The bias means comprises the pivot being resilient for biasing the latch into a locking position. In one example of the invention, the latch is molded from a unitary polymeric material with the trigger. The bias means comprises the pivot being a resilient unitary polymeric material. In another example of the invention, the trigger defines a void with the latch being disposed within the void.

In another embodiment of the invention, the bias means biases the latch into the locking position for automatically locking the latch into engagement with the body upon the return of the trigger into the extended position. The bias means requires the latch to be maintained in the unlocking position in order to reciprocate the trigger between the extended position and the retracted position.

In another embodiment of the invention, the body includes a wall of the body extending generally parallel to an axis of pivot of the trigger. The latch includes a hook for engaging an upper surface of the wall of the body for inhibiting the movement of the trigger from the extended position.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
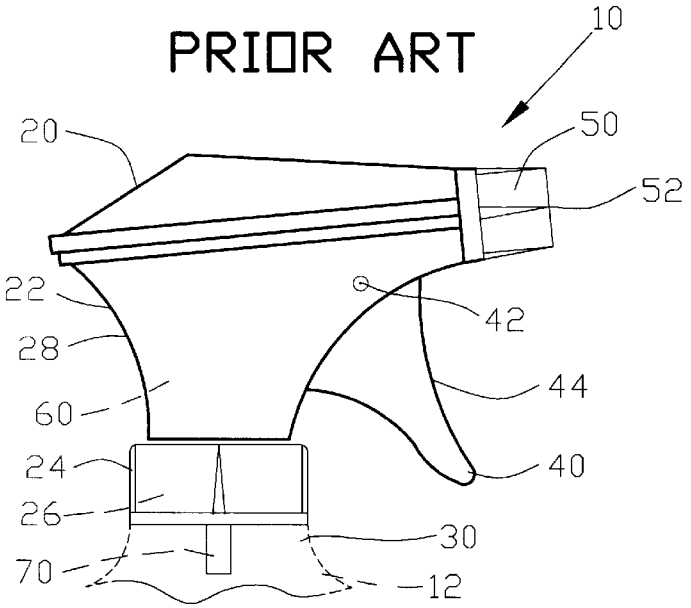
FIG. 1 is a side view of a fluid sprinkling device of the prior art disposed in an expanded or unattended position.
Figure 2:
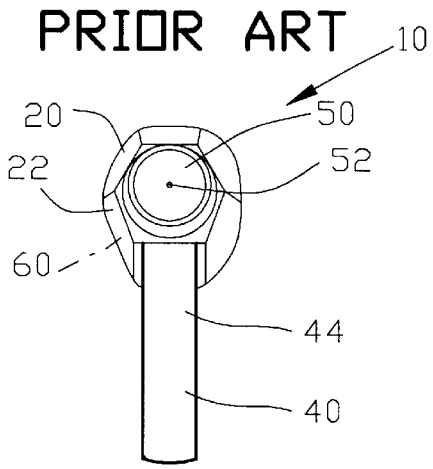
FIG. 2 is a partial front view of FIG. 1.

FIGS. 1 and 2 are side and front views of a fluid sprinkling device 10 known to the prior art for dispensing a fluid 12. The fluid sprinkling device 10 comprises a fluid dispenser 20 secured to a container 30. The fluid dispenser 20 includes a body 22 having a closure 24 for securing the container 30. Typically, the closure 24 includes threads (not shown) for threadably securing to the container 30. The body 22 includes a rear surface 28 located on an opposite side of the body 22 from a trigger 40.

The trigger 40 is pivotably mounted on a pivot 42 relative to the body 22. The trigger 40 includes a finger receiving surface 44 for enabling an operator to move the trigger 40 about the pivot 42 between the extended or unattended position shown in FIG. 1 and a retracted position shown in FIG. 3.

A dispenser head 50 is connected to the body 22. The dispenser head 50 defines a terminal orifice 52 for dispensing the fluid 12 from the container 30. A pump 60 is disposed within the body 22 and is in fluid communication with the container 30 through an induction tube 70. The pump 60 provides fluid communication between the container 30 and the terminal orifice 52 for dispensing the fluid 12 from the container 30.

Figure 3:
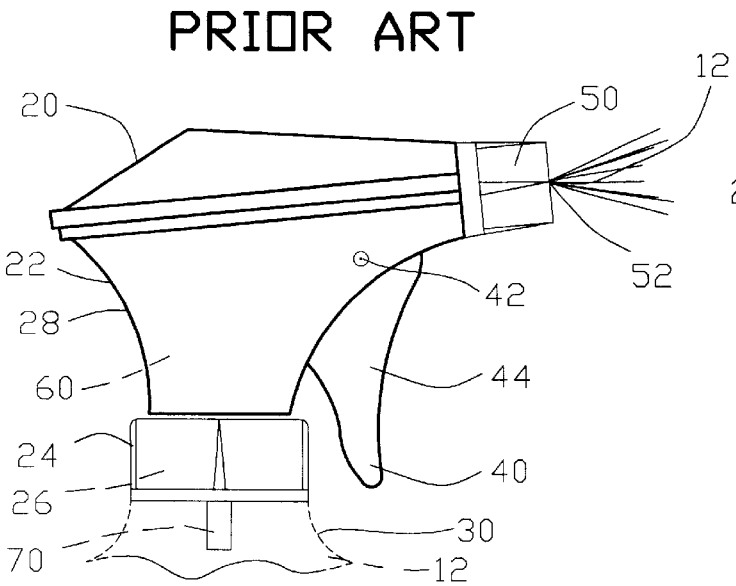
FIG. 3 is a side view of the fluid sprinkling device of FIG. 1 disposed in a retracted position.
Figure 4:
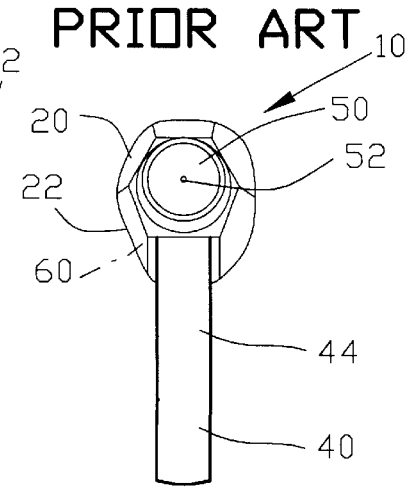
FIG. 4 is a partial front view of FIG. 2.

FIGS. 3 and 4 are side and front views of a fluid sprinkling device 10 of FIGS. 1 and 2 with the trigger 40 being located in a retracted position. The reciprocation of the trigger 40 between the extended position shown in FIG. 1 and the retracted position shown in FIG. 3 results in the pumping of the fluid 12 from the container 30 to be discharged through the terminal orifice 52.

The fluid sprinkling device 10 is held by a hand of an operator as follows. The rear surface 28 rests at the intersection of the thumb and the index finger of the operator. The third and fourth fingers of the operator extend about the closure 30 for holding the fluid sprinkling device 10. The index finger and the middle finger of the operator are positioned on the finger receiving surface 44 of the trigger 40. The index finger and the middle finger reciprocate the trigger 40 to pump the fluid 12 from the container 30 to be discharged through the terminal orifice 52.

The fluid sprinkling device 10 shown in FIGS. 1–4 has provided an efficient and convenient means for dispensing the fluid 12 from the container 30. Unfortunately, the fluid sprinkling device 12 may be operated by a child. In some cases, a child will grasp the fluid sprinkling device 10 with two hands. Both of the thumbs of the child rest on the finger receiving surface 44 of the trigger 40 with the remaining fingers of both hands resting on the rear surface 28. In this orientation, the terminal orifice 52 is directed toward the face and mouth of the child. When the container 30 is filled with materials such as bleach, insecticides, industrial cleaners, oven cleaners or the like, dispensing the fluid into the face or mouth of the child can be very dangerous.

Figure 5:
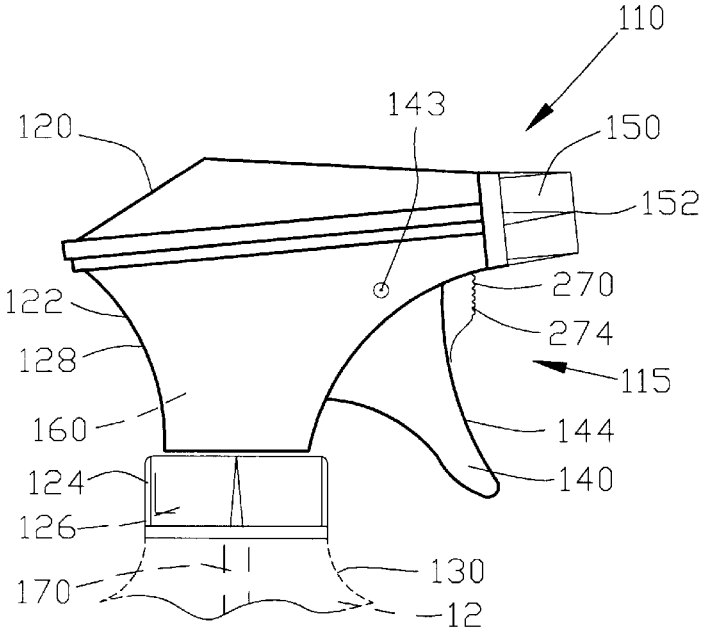
FIG. 5 is a side view of a fluid sprinkling device incorporating the present invention and shown in an expanded and locked position.
Figure 6:
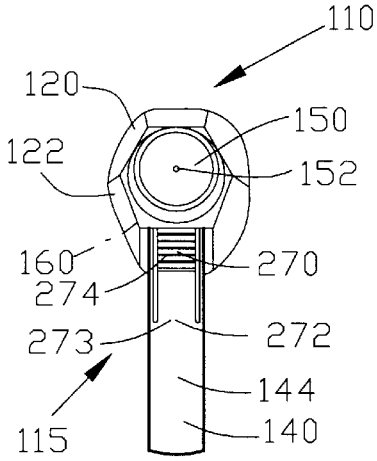
FIG. 6 is a partial front view of FIG. 5.

FIG. 5 is a side view of a fluid sprinkling device 110 of the prior art in an extended and locked position with FIG. 6 being a partial front view of FIG. 5. As will be described in greater detail hereinafter, the fluid sprinkling device 110 incorporates the child resistant device 115 of the present invention.

The fluid sprinkling device 110 comprise s a fluid dispenser 120 secured to a container 130. The fluid dispenser 120 includes a body 122 having a closure 124 for securing the container 130. The body 122 includes a rear surface 128 located on an opposite side of the body 122 from a trigger 140.

The fluid dispenser 120 supports a trigger 140 pivotably mounted on a pivot 142 relative to the body 122. The trigger 140 is pivotably mounted on the pivot 142 about a trigger axis 143. The trigger 140 includes a finger receiving surface 144 for enabling an operator to move the trigger 140 about the pivot 142 between the extended or unattended position shown in FIG. 5 and a retracted position shown in FIG. 7.

A dispenser head 150 is connected to the body 122. The dispenser head 150 defines a terminal orifice 152 for dispensing the fluid 12 from the container 130. A pump 160 is disposed within the body 122 and is in fluid communication with the container 130 through an induction tube 170. The pump 160 provides fluid communication between the container 130 and the terminal orifice 152 for dispensing the fluid 12 from the container 130.

Figure 7:
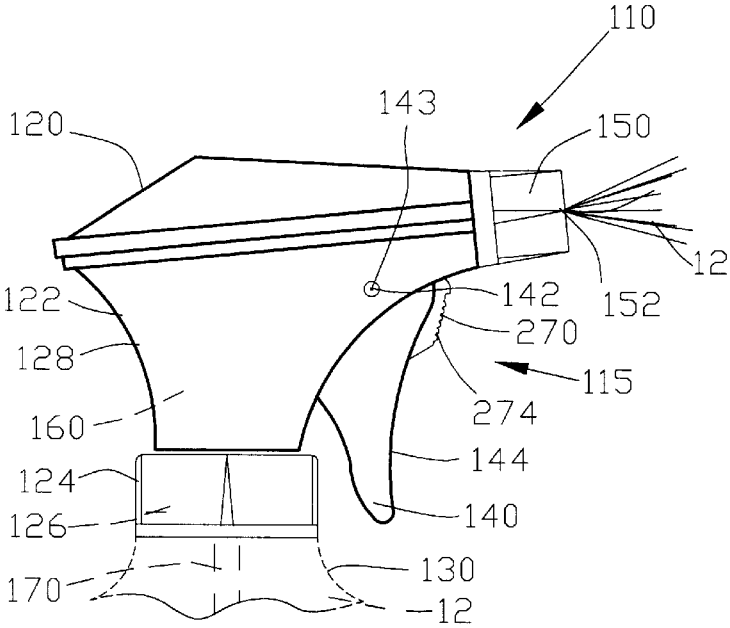
FIG. 7 is a side view of the fluid sprinkling device of FIG. 5 in a retracted position.
Figure 8:
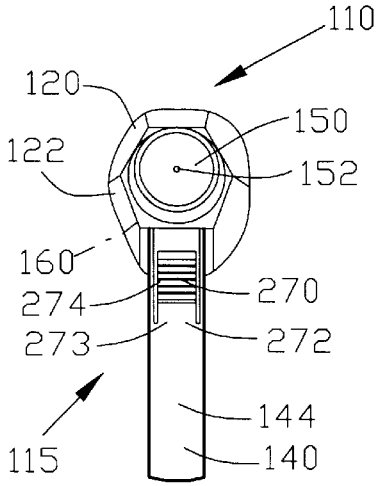
FIG. 8 is a partial front view of FIG. 7.

FIG. 7 is a side view of the fluid sprinkling device 110 of FIG. 5 with the trigger 140 being located in a retracted position. FIG. 8 is a partial front view of FIG. 7. The reciprocation of the trigger 140 by an operator between the extended position shown in FIG. 5 and the retracted position shown in FIG. 7 results in the pumping of the fluid 12 from the container 130 to be discharged through the terminal orifice 152.

Figure 9:
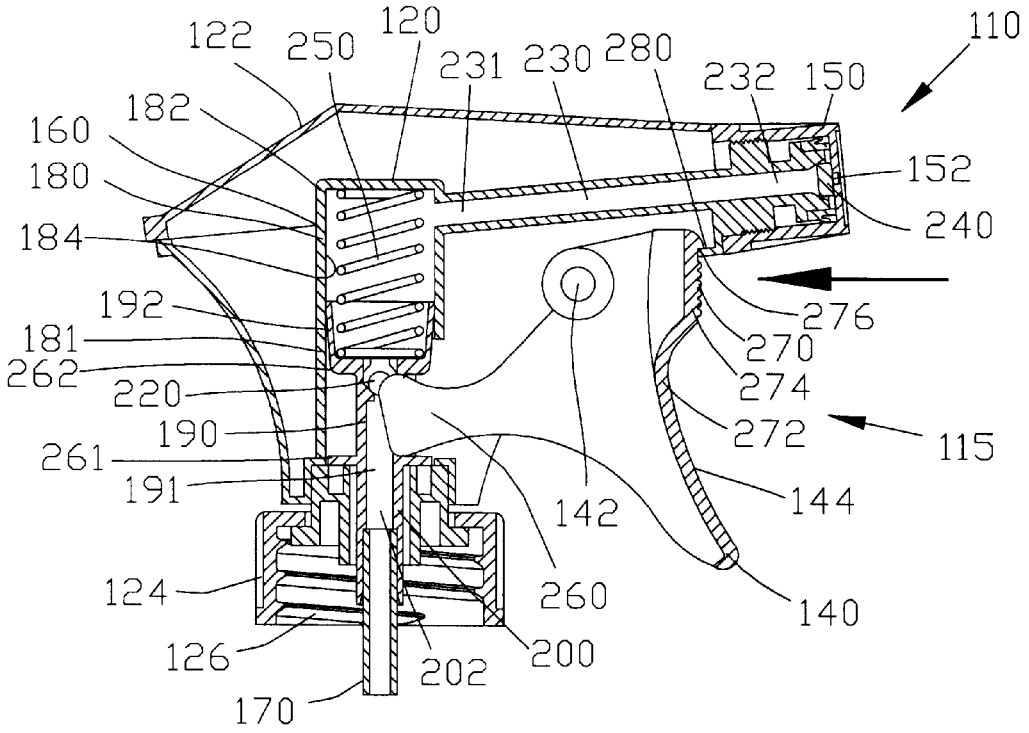
FIG. 9 is a sectional view of the fluid sprinkling device of FIGS. 5 and 6 in the extended and locked position.

FIG. 9 is a sectional view of the fluid dispenser 120 of FIGS. 5 and 6 in the extended and locked position. The body 122 is secured to the closure 124 with the closure 124 having closure threads 126 for securing to container threads (not shown) extending about a container rim 132 of the container 130 in a conventional fashion. When the closure 124 is secured to the container 130, the pump 160 is sealed to the container 130.

The pump 160 comprises a pump cylinder 180 having a first and a second cylinder end 181 and 182 with an internal cylinder surface 184 defined therebetween. The first and second cylinder ends 181 and 182 of the pump cylinder 180 is supported by the body 122.

A piston 190 having a first and a second piston portion 191 and 192 is disposed within the pump cylinder 180. The first piston portion 191 of the piston 190 defines a duct 200 extending through the piston 190. The second piston portion 192 of the piston 190 forms a sliding seal with the internal cylinder surface 184 of the pump cylinder 180.

A duct 200 extends through the first piston portion 192 of the piston 190 to define an internal duct conduit 202. The internal duct conduit 202 provides communicating through the piston 190 into the second cylinder end 182 of the pump cylinder 180.

An induction tube 170 is frictionally secured into a portion of the duct conduit 202. The induction tube 170 provides fluid communication between the fluid 12 within the container 130 to pump cylinder 180 through the second piston portion 192 of the piston 190 into the second cylinder end 182 of the pump cylinder 180.

A first one-way valve 220 is located within the duct conduit 202 for enabling the flow of the fluid 12 only from the container 130 through the piston 190 into the second end 182 of the pump cylinder 180.

The second end 182 of the pump cylinder 180 communicates with a first end 231 of a discharge tube 230. The discharge tube 230 communicates through a second one-way valve 240 to the terminal orifice 152. The second one-way valve 240 enables the flow of the fluid 12 only from the pump cylinder 180 through the terminal orifice 152.

A helical metallic spring 250 coacts between the body 122 and the piston 190 for biasing the piston 190 into the position as shown in FIG. 9. In this embodiment of the invention, the helical metallic spring 250 coacts between the second end 182 of the pump cylinder 180 and the second piston portion 192 of the piston 190.

The trigger 140 is pivotably mounted on the pivot 142 supported by the body 122. The trigger 140 includes an actuator 260 retained between a first and a second keeper 261 and 262 secured to the piston 190. The reciprocation of the trigger 140 between the extended position shown in FIG. 5 and the retracted position shown in FIG. 7 reciprocates the piston 190 within the cylinder 180. The reciprocation of the piston 190 within the pump cylinder 180 results in the pumping of the fluid 12 from the container 20 through the terminal orifice 152.

The child resistant device 115 of the present invention comprises a latch 270 movably mounted on the trigger 140 about a pivot 272 having a pivot axis 273. The latch pivot axis 273 is substantially aligned to be parallel with the trigger pivot axis 143. The latch 270 includes an index finger receiver 274 for receiving the index finger of the operator. The latch 270 is biased into a locking position shown in FIG. 9 whereat a catch 276 engages with a body wall 280 extending from the body 122 to inhibit movement of the trigger 140.

Figure 10:
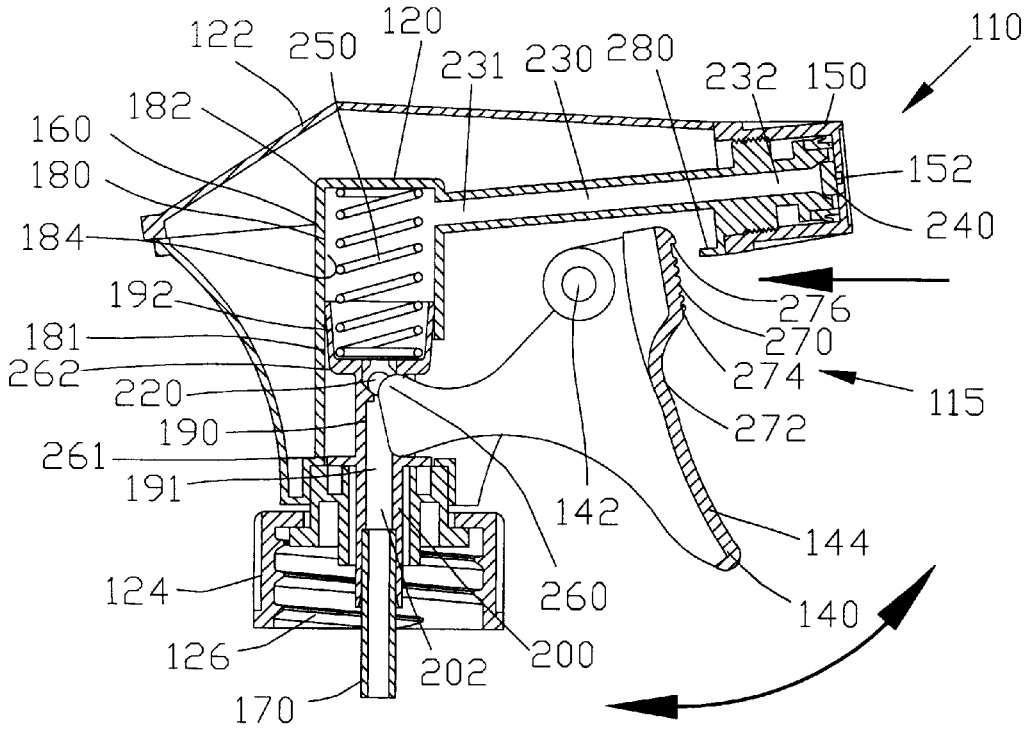
FIG. 10 is a sectional view of the fluid sprinkling device of FIG. 9 in the expanded and unlocked position.

FIG. 10 is a sectional view of the fluid dispenser 120 of FIG. 9 in the expanded and unlocked position. FIG. 10 illustrates an intermediate step of pivoting the latch 270 about the pivot axis 273 to disengage the catch 276 from the body wall 280 to permit movement of the trigger 140. The latch 270 is pivoted by the index finger of the operator for unlocking the trigger 140.

Figure 11:
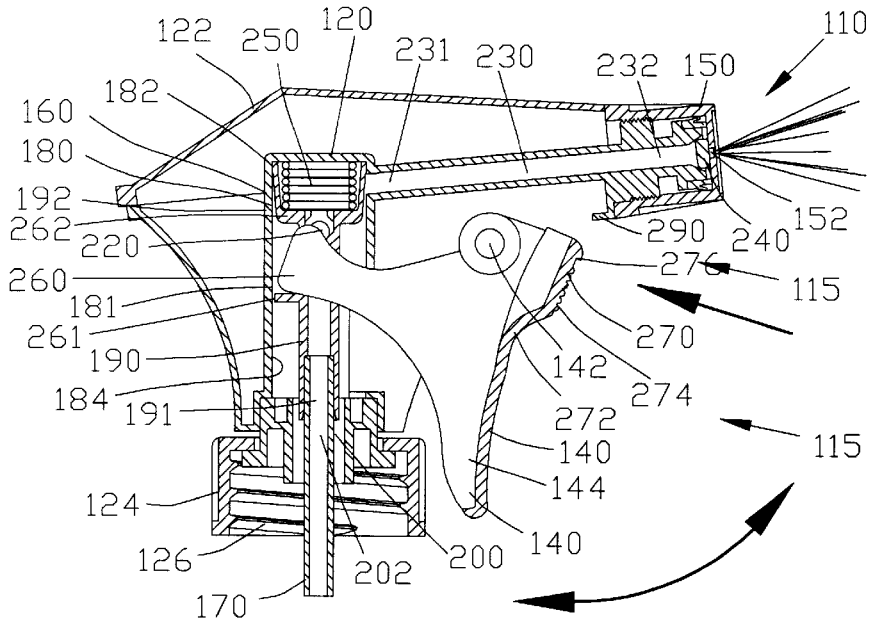
FIG. 11 is a sectional view of the fluid sprinkling device of FIG. 10 in a retracted position.

FIG. 11 is a sectional view of the fluid dispenser 120 of FIG. 10 in a retracted position. While the latch 270 is maintained in the unlocked position by the index finger of the operator, the middle finger of the operator reciprocates the trigger 140 between the extended position shown in FIG. 9 and the retracted position shown in FIG. 11. The latch 270 is maintained in the unlocked position by the index finger while the trigger 140 is reciprocated by the middle finger of the operator.

The fluid dispenser 120 operates in the following manner. The metallic spring 250 biases the piston 190 into the position shown in FIG. 9. Since the actuator 260 of the trigger 140 is retained between the first and second keepers 261 and 262, the metallic spring 250 moves the trigger 140 into the extended or unattended position of FIG. 9.

The latch 270 is biased into the locking position for automatically locking the latch 270 into engagement with the body wall 290 upon the movement of the trigger 140 into the expanded position. The latch 270 is unlocked by the index finger of the operator as shown in FIG. 10. The middle finger of the operator moves the trigger 140 from the extended position shown in FIG. 10 to the retracted position shown in FIG. 11. The latch 270 is maintained in the unlocked position by the index finger while the trigger 140 is moved by the middle finger of the operator.

The movement of the trigger 140 into the retracted position as shown in FIG. 11 compresses the volume within the pump cylinder 180 to discharge fluid from the terminal orifice 152. When the trigger 190 is released by the operator, the metallic spring 250 returns the piston 190 into the position shown in FIG. 10. The return of the piston 190 into the position shown in FIG. 10 forms a low pressure within the pump cylinder 180 to withdraw the fluid 12 from the container 30 into the pump cylinder 180. The subsequent movement of the trigger 140 into the retracted position as shown in FIG. 11 again compresses the volume within the pump cylinder 180 to discharge fluid from the terminal orifice 152. Since the latch 270 automatically locks with the body wall 280, the latch must be maintained in the unlocking position as shown in FIGS. 10 and 11 in order to reciprocate the trigger 140 between the expanded position and the retracted position.

The child resistant device 115 of the present invention uses two principles to make the fluid dispenser child resistant. First, the child resistant device 115 of the present invention uses the difference in size between the hand of an adult and a hand of a child. Second, the child resistant device 115 of the present invention uses a first and a second dissimilar or independent movement.

The distance from trigger 140 to the rear surface 128 of the body 122 conforms to the size of an adult hand. This distance from trigger 140 to the rear surface 128 of the body 122 is greater than the finger reach of a child. Accordingly, the operation of the latch is very awkward and unstable for a child thus inhibiting the simultaneously movement of the latch and the trigger.

The child resistant device 115 of the present invention requires the first and the second dissimilar or independent movement to discharge fluid from the terminal orifice 152. The first movement is the pivoting of the latch 270 by the index finger of the operator as shown by the small arrow in FIG. 10. The second movement is the reciprocation of the trigger 140 by the middle finger of the operator as shown by the large arrow in FIG. 10.

The first movement of the latch 270 by the index finger is in a direction substantially toward the trigger pivot axis 143 of the trigger 140. The direction of the first movement of the latch 270 does not create a lever arm relative to the trigger pivot axis 143. Accordingly, the direction of the first movement of the latch 270 has an insufficient lever arm relative to the trigger pivot axis 143 to pivot the trigger 140 even for an adult.

The second movement of the trigger 140 by the middle finger creates a substantial lever arm relative to the trigger pivot axis 143. Accordingly, the direction of the second movement of the latch 270 has a sufficient lever arm relative to the trigger pivot axis 143 to pivot the trigger 140.

The position of the latch 270 relative to the trigger pivot 142 makes the first and second movements dissimilar or independent. These first and second dissimilar or independent movements make the operation of the fluid dispenser 120 difficult for a child. Accordingly, it is very unlikely that a child will be able to discharge fluid from the terminal orifice 152.

Figure 12:
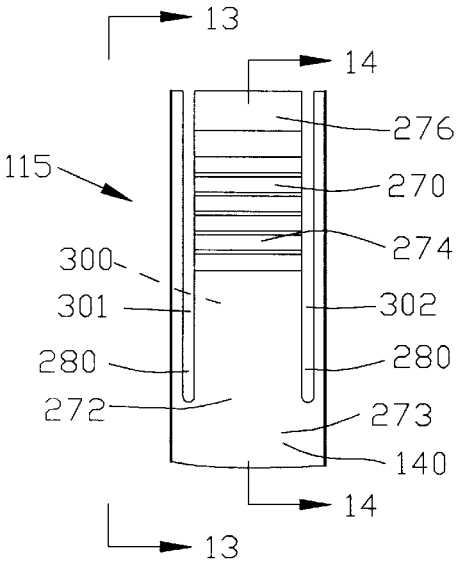
FIG. 12 is a magnified view of a portion of the trigger of FIG. 6.
Figure 13:
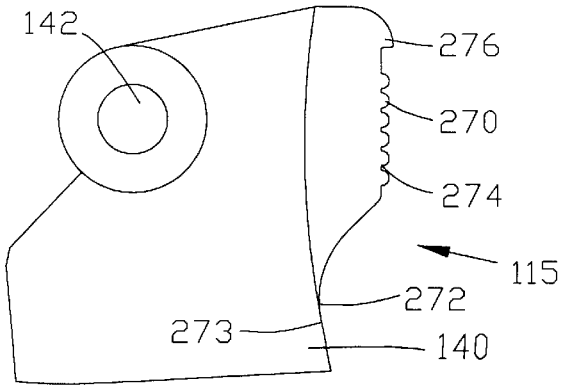
FIG. 13 is a view along line 13—13 in FIG. 12.

FIG. 12 is a magnified view of a portion the trigger of FIG. 6 with FIG. 13 being a view along line 13—13 in FIG. 12. The trigger 140 defines a void 300 with the latch 270 being disposed within the void 300. The void 300 includes a first and second void portion 301 and 302 disposed on opposed sides of the latch 270.

In this embodiment of the invention, the latch 270 is integrally formed with the trigger 140. The latch pivot 272 integrally interconnects the latch 270 to the trigger 140. The latch pivot axis 273 of the latch pivot 272 is substantially aligned to be parallel with the trigger pivot axis 143 of the trigger pivot 140. Preferably, the latch 270 is molded from a unitary polymeric material with the trigger 140 with the resilient pivot 272 comprising a resilience of the unitary polymeric material.

Figure 14:
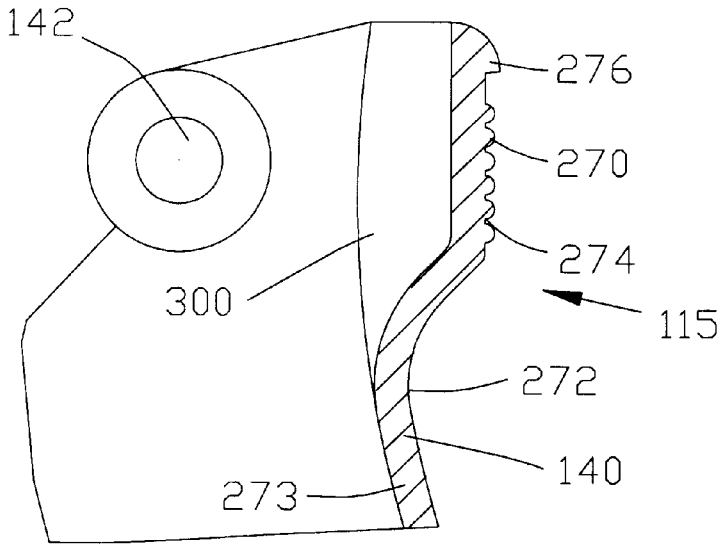
FIG. 14 is a view along line 14—14 in FIG. 12 illustrating a latch in a locking position.

FIG. 14 is a view along line 14—14 in FIG. 12 illustrating a latch 270 in a locking position. The resilience of the unitary polymeric material of the resilient pivot 272 provides a bias means for resiliently interconnection the latch 270 to the trigger 140. The bias means biases the latch 270 into the locking position as shown in FIG. 14.

Figure 15:
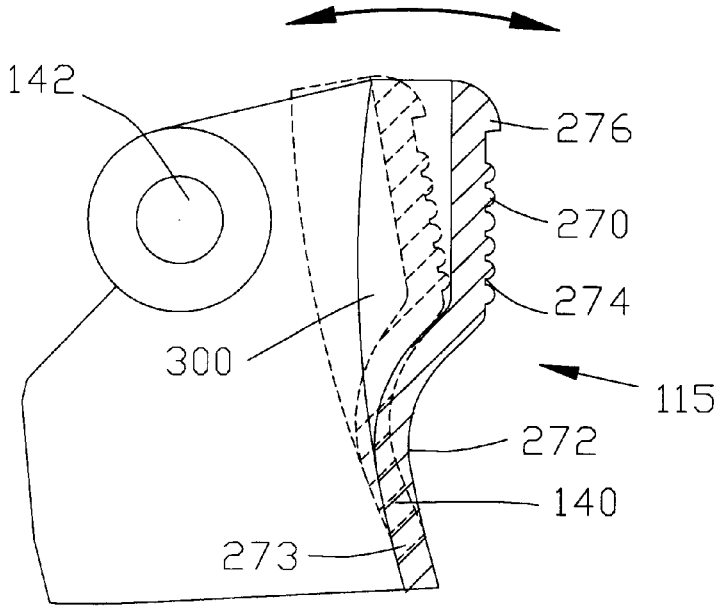
FIG. 15 is a view similar to FIG. 14 illustrating the latch in an unlocking position.

FIG. 15 is a view similar to FIG. 14 illustrating the latch 270 in an unlocking position. The latch 270 is movable into the unlocking position for permitting the movement of the trigger 140 from the expanded position. The latch 270 is movable through the resilient deformation of the latch pivot 272 about the pivot axis 273. The resilient deformation of the latch pivot 272 about the pivot axis 273 is shown by the phantom position in FIG. 15.

Figure 16:
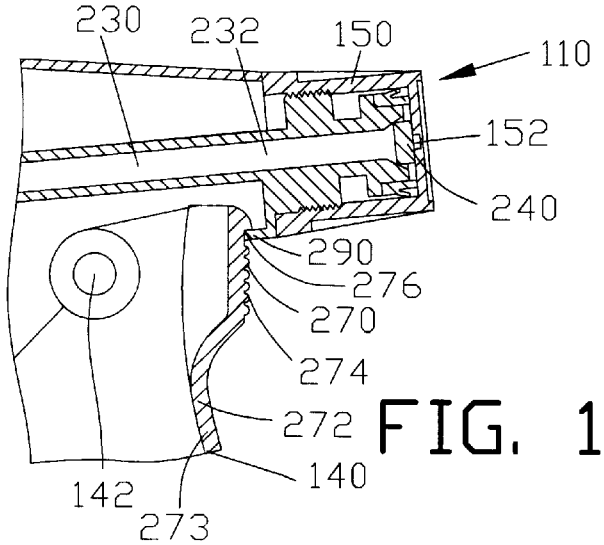
FIG. 16 is an enlarged view of a portion of the fluid sprinkling device of FIG. 9 with the trigger in an expanded and locked position.

FIG. 16 is an enlarged view of a portion of the fluid dispenser 120 of FIG. 9 with the trigger in the expanded and locked position. The body wall 290 of the body 122 extends generally parallel to an trigger pivot axis 143 of the trigger pivot 142. The body wall 290 may be integrally formed with the body 122 or may be an attachment to the body 122. For example, the body wall 290 may be formed as a part of the dispenser head 150 or a rotatable dispenser head. The latch 270 includes a catch 276 for engaging an upper surface of the body wall 280 of the body 122 for inhibiting the movement of the trigger from the expanded position.

Figure 17:
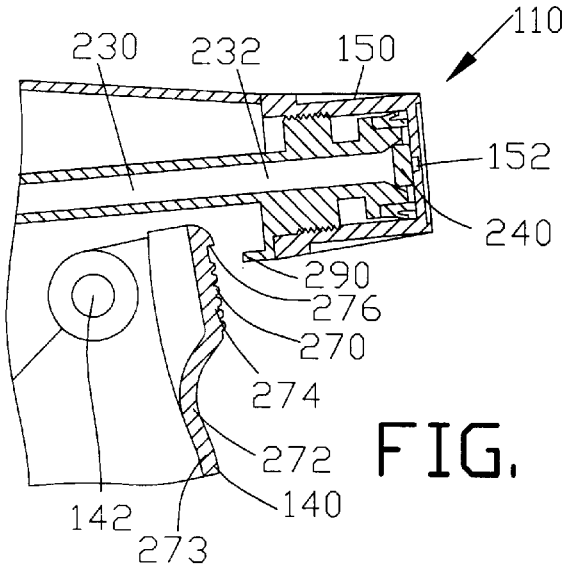
FIG. 17 is an enlarged view of a portion of the fluid sprinkling device of FIG. 10 with the trigger in the expanded and unlocked position.

FIG. 17 is an enlarged view of a portion of the fluid dispenser 120 of FIG. 10 with the trigger 140 located in the expanded and unlocked position. The latch 270 is pivoted through the resilient deformation of the latch pivot 272 about the pivot axis 273 by the index finger of the operator for unlocking the trigger 140.

Figure 18:
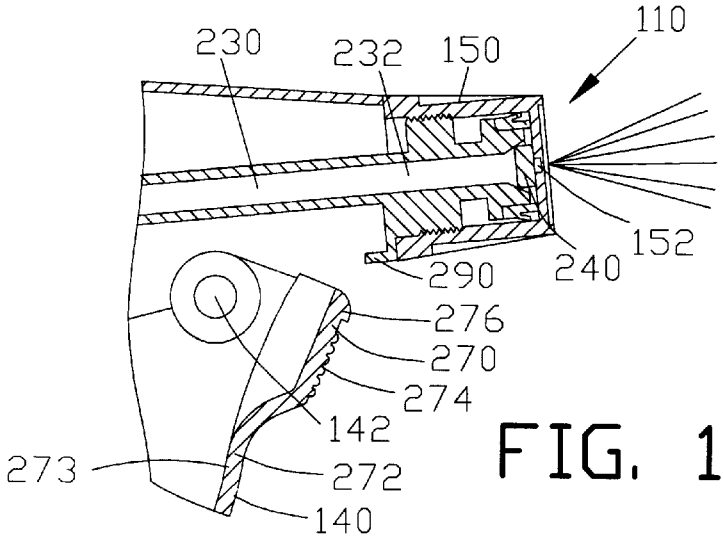
FIG. 18 is an enlarged view of a portion of the fluid sprinkling device of FIG. 11 with the trigger in the retracted position.

FIG. 18 is an enlarged view of a portion of the fluid sprinkling device of FIG. 11 with the trigger in the retracted position. While the latch 270 maintained in the unlocked position by the index finger of the operator, the middle finger of the operator moves the trigger 140 into the retracted position shown in FIG. 18. The latch 270 is maintained in the unlocked position by the index finger while the trigger 140 is reciprocated by the middle finger of the operator. The latch 270 is automatically relocked into engagement with the body wall 280 upon the return of the trigger 140 and upon the release of the latch 270.

It should be understood that the present invention relates to a child resistant device for use with a trigger of a fluid dispenser. The child resistant device of the present invention is adaptable to various types and designs of triggers as well as various types and designs of fluid dispensers. The fluid sprinkling devices and the fluid dispenser set forth herein is merely an example and does not form a part of the invention.

The child resistant device of the present invention provides an effective self-locking device for a trigger of a fluid dispenser. The present invention provides a child resistant device without little or no increase in cost to the fluid dispenser.

Although the latch is integrally added to a conventional trigger, the new trigger may be molded from modified molds rather than requiring new molds. Similarly, the body may be molded from modified molds rather than requiring new molds. Accordingly, little or no additional material is needed to mold the trigger and the body of the fluid dispenser thereby maintaining the same cycle time during the molding process. The child resistant device of the present invention may be incorporated into a wide variety of trigger as well as a wide variety of body of the prior art fluid dispensers.

The same or similar assembly equipment can be used for assembling the fluid dispenser incorporating the child resistant device. The assembly equipment would be modified only to check the operation of the latch function. Accordingly the child resistant device may be incorporated into a fluid dispenser without a substantial capitol investment.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A child resistant device for use with a trigger of a fluid dispenser, the fluid dispenser comprising a body pivotably supporting the trigger for dispensing the fluid from a container upon movement of the trigger between an extended position and a retracted position, the improvement comprising:

a latch movably mounted on the trigger;

said latch being unitary with the trigger;

a latch bias for biasing said latch into a locking position whereat said latch engages the body for inhibiting the movement of the trigger from the extended position; and said latch being movable into an unlocking position whereat said latch disengages from the body for permitting the movement of the trigger from the extended position.

2. A child resistant device for use with a trigger of a fluid dispenser as set forth in claim 1, wherein said latch is pivotable on the trigger about a latch pivot axis;

the trigger being pivotably mounted to the body about a trigger axis with said latch pivot axis being substantially aligned to be parallel with said trigger pivot axis.

3. A child resistant device for use with a trigger of a fluid dispenser as set forth in claim 1, wherein a pivot integrally interconnects said latch and the trigger; and said latch bias comprising said pivot being resilient for biasing said latch into a locking position.

4. A child resistant device for use with a trigger of a fluid dispenser as set forth in claim 1, wherein said latch is molded from a unitary polymeric material with the trigger.

5. A child resistant device for use with a trigger of a fluid dispenser as set forth in claim 1, wherein the trigger defines a void; and said latch integrally extending from the trigger into said void.

6. A child resistant device for use with a trigger of a fluid dispenser as set forth in claim 1, wherein the trigger defines a void;

said latch being disposed within said void; and a pivot integrally interconnecting said latch to the trigger, said latch bias comprising said pivot resiliently interconnecting said latch to the trigger.

7. A child resistant device for use with a trigger of a fluid dispenser as set forth in claim 1, wherein the trigger is biased into the extended position; and said latch bias biasing said latch into said locking position automatically relocking said latch into engagement with the body upon the return of the trigger into the extended position.

8. A child resistant device for use with a trigger of a fluid dispenser as set forth in claim 1, wherein the body includes a wall of the body; and said latch engaging the body including said latch having a catch for engaging said wall of the body for inhibiting the movement of the trigger from the extended position.

9. A child resistant device for use with a trigger of a fluid dispenser as set forth in claim 1, wherein the body includes a body wall extending generally parallel to a trigger pivot axis of the trigger; and said latch engaging the body including said latch having a catch for engaging an upper surface of said body wall for inhibiting the movement of the trigger from the extended position.

10. A child resistant device for use with a trigger of a fluid dispenser, the fluid dispenser comprising a body pivotably supporting the trigger for dispensing the fluid from a container upon movement of the trigger between an extended position and a retracted position, the improvement comprising:

a latch pivot for pivotably mounting a latch on the trigger;

said latch and said latch pivot being molded from a resilient unitary polymeric material with the trigger;

said resilient polymeric material biasing said latch into a locking position whereat said latch engages the body for inhibiting the movement of the trigger from the extended position; and said latch being movable into an unlocking position whereat said latch disengages from the body for permitting the movement of the trigger from the extended position.

11. A child resistant device for use with a trigger of a fluid dispenser as set forth in claim 10, wherein the trigger defines a void with said latch being disposed within said void.

12. A child resistant device for use with a trigger of a fluid dispenser the fluid dispenser comprising a body pivotably supporting the trigger for dispensing the fluid from a container upon movement of the trigger between an extended position and a retracted position, the improvement comprising:

a latch pivot for pivotably mounting a latch on the trigger:

said latch and said latch pivot being molded from a resilient unitary polymeric material with the trigger;

said latch pivot being a resilient unitary polymeric material for biasing said latch into a locking position whereat said latch engages the body for inhibiting the movement of the trigger from the extended position;

said latch being movable into an unlocking position whereat said latch disengages from the body for permitting the movement of the trigger from the extended position; and said resilient unitary polymeric material biasing said latch into said locking position for automatically relocking said latch into engagement with the body upon the return of the trigger into the extended position thereby requiring said latch to be maintained in said unlocking position in order to reciprocate the trigger between the extended position and the retracted position.

13. A child resistant trigger for use with a fluid dispenser, the fluid dispenser comprising a body supported by a container for dispensing the fluid therefrom, comprising:

a trigger pivotably supporting on the body about a trigger pivot axis between an extended position and a retracted position, the fluid dispenser biasing said trigger into said extended position;

said trigger cooperating with the fluid dispenser for spraying the fluid from the container upon reciprocation of the trigger between the extended position and the retracted position;

a resilient pivot for pivotably mounting a latch to said trigger;

said latch being integrally formed with said trigger through said resilient pivot;

said resilient pivot biasing said latch into a locking position whereat said latch engages the body for inhibiting the movement of said trigger from the extended position; and said latch being movable into an unlocking position whereat said latch disengages from the body for permitting the movement of said trigger from the extended position.

14. A child resistant trigger for use with a fluid dispenser as set forth in claim 13, wherein said pivot pivotably mounts said latch on the trigger about a latch pivot axis;

the trigger being pivotably mounted to the body about said trigger pivot axis with said latch pivot axis being substantially aligned to be parallel with said trigger pivot axis.

15. A child resistant trigger for use with a fluid dispenser as set forth in claim 13, wherein said latch is molded from a unitary polymeric material with the trigger.

16. A child resistant trigger for use with a fluid dispenser as set forth in claim 13, wherein the trigger defines a void with said latch extending into said void for enabling said latch to pivot into said void.

17. A child resistant device for use with a trigger of a fluid dispenser as set forth in claim 13, wherein said resilient pivot biases said latch into a locking position for automatically relocking said latch into engagement with the body upon the return of the trigger into the extended position.

18. A child resistant device for use with a trigger of a fluid dispenser as set forth in claim 13, wherein said resilient pivot biases said latch into a locking position for automatically relocking said latch into engagement with the body upon the return of the trigger into the extended position thereby requiring said latch to be maintained in said unlocking position in order to reciprocate the trigger between the extended position and the retracted position.

19. A child resistant device for use with a trigger of a fluid dispenser as set forth in claim 13, wherein the body includes a body wall; and said latch engaging the body including said latch having a catch for engaging said body wall for inhibiting the movement of the trigger from the extended position.

20. A child resistant device for use with a trigger of a fluid dispenser as set forth in claim 13, wherein the body includes a body wall extending generally parallel to said trigger pivot axis of the trigger; and said latch engaging the body including said latch having a catch for engaging an upper surface of said body wall for inhibiting the movement of the trigger from the extended position.

21. A child resistant device for use with a trigger of a fluid dispenser, the fluid dispenser comprising a body pivotably supporting the trigger for dispensing the fluid from a container upon movement of the trigger between an extended position and a retracted position, the improvement comprising:

a latch movably mounted on the trigger;

a latch bias for biasing said latch into a locking position whereat said latch engages a portion of the body forward of said trigger for inhibiting the movement of the trigger from the extended position; and said latch being movable into an unlocking position whereat said latch disengages from the body for permitting the movement of the trigger from the extended position.

22. A child resistant device for use with a trigger of a fluid dispenser, the fluid dispenser comprising a body pivotably supporting the trigger for dispensing the fluid from a container upon movement of the trigger between an extended position and a retracted position, the improvement comprising:

a latch unitarily molded with the trigger;

a latch bias unitarily molded with said latch and with the trigger for biasing said latch into a locking position whereat said latch engages the body for inhibiting the movement of the trigger from the extended position; and said latch being movable into an unlocking position whereat said latch disengages from the body for permitting the movement of the trigger from the extended position.

* * * * *